US010626708B2

(12) United States Patent
Cedillo et al.

(10) Patent No.: US 10,626,708 B2
(45) Date of Patent: Apr. 21, 2020

(54) DURABLE DART PLUNGER

(71) Applicant: Endurance Lift Solutions, LLC, Gainesville, TX (US)

(72) Inventors: Jason N. Cedillo, Houston, TX (US); Donald Robison, Houston, TX (US); Jeffrey B. Zimmerman, Jr., Denver, CO (US)

(73) Assignee: Endurance Lift Solutions, Inc., Gainesville, TX (US)

( * ) Notice: Subject to any disclaimer, the term of this patent is extended or adjusted under 35 U.S.C. 154(b) by 0 days.

(21) Appl. No.: 15/989,103

(22) Filed: May 24, 2018

(65) Prior Publication Data

US 2018/0266220 A1 Sep. 20, 2018

Related U.S. Application Data

(63) Continuation of application No. 15/396,188, filed on Dec. 30, 2016, now Pat. No. 10,006,274, which is a continuation-in-part of application No. 14/472,044, filed on Aug. 28, 2014, now Pat. No. 9,976,548.

(51) Int. Cl.

| | |
|---|---|
| ***E21B 43/12*** | (2006.01) |
| ***F04B 39/00*** | (2006.01) |
| ***E21B 34/06*** | (2006.01) |
| ***F04B 31/00*** | (2006.01) |
| ***F04B 47/12*** | (2006.01) |

(52) U.S. Cl.

CPC ..... *E21B 43/123* (2013.01); *E21B 34/06* (2013.01); *E21B 43/121* (2013.01); *F04B 31/00* (2013.01); *F04B 39/0016* (2013.01); *F04B 47/12* (2013.01)

(58) Field of Classification Search

CPC ..... F04B 39/0016; F04B 47/00; F04B 47/12; F04B 31/00; F04C 13/008; E21B 43/121; E21B 43/128; E21B 43/122; E21B 43/123; E21B 43/00; E21B 34/06

See application file for complete search history.

(56) References Cited

U.S. PATENT DOCUMENTS

| | | | |
|---|---|---|---|
| 2,878,754 | A | 3/1959 | McMurry |
| 3,029,872 | A | 4/1962 | Hanes |
| 4,239,458 | A | 12/1980 | Yeatts |
| 5,341,539 | A | 8/1994 | Sheppard et al. |

(Continued)

FOREIGN PATENT DOCUMENTS

WO WO2013131165 A1 9/2013

OTHER PUBLICATIONS

International Search Report and Written Opinion PCT/US2015/042038 dated Oct. 7, 2015.

(Continued)

*Primary Examiner* — Wei Wang
(74) *Attorney, Agent, or Firm* — Hall Estill Law Firm

(57) ABSTRACT

Provided is an improved bypass durable dart plunger that descends faster in a hydrocarbon well, is capable of lifting more fluids and has a durable and replaceable clutch assembly. The various components of the durable dart plunger includes a sleeve, a dart body with a one or more flow ports (chokes) cut at right angles through the dart body, a pin and a replaceable clutch assembly (also referred to a retention assembly). The chokes can be of varying sizes. In one embodiment, the clutch assembly includes a plurality of clutch mechanisms wherein each mechanism includes a ball, a socket screw and a resilient spacer.

20 Claims, 16 Drawing Sheets

(56) References Cited

U.S. PATENT DOCUMENTS

| | | | |
|---|---|---|---|
| 6,148,923 | A | 11/2000 | Casey |
| 6,209,637 | B1 | 4/2001 | Wells |
| 6,293,340 | B1 | 9/2001 | Wu |
| 6,467,541 | B1 | 10/2002 | Wells |
| 6,719,060 | B1 | 4/2004 | Wells |
| 6,883,612 | B2 | 4/2005 | Ferguson et al. |
| 6,935,427 | B1 | 8/2005 | Billingsley |
| 7,188,670 | B2 | 3/2007 | Amies et al. |
| 7,383,878 | B1 | 6/2008 | Victor |
| 8,181,706 | B2 | 5/2012 | Tanton |
| 8,327,931 | B2 | 12/2012 | Agrawal et al. |
| 8,347,955 | B1 | 1/2013 | Sewell et al. |
| 8,403,307 | B2 | 3/2013 | Koeske et al. |
| 8,528,633 | B2 | 9/2013 | Agrawal et al. |
| 8,573,295 | B2 | 11/2013 | Johnson et al. |
| 8,714,268 | B2 | 5/2014 | Agrawal et al. |
| 9,068,443 | B2 | 6/2015 | Jeffries et al. |
| 2003/0094283 | A1 | 5/2003 | Iannikov et al. |
| 2005/0161223 | A1 | 7/2005 | Shulyatikov et al. |
| 2007/0246211 | A1 | 10/2007 | Schneider et al. |
| 2008/0271898 | A1 | 11/2008 | Turley et al. |
| 2010/0084138 | A1 | 4/2010 | Inglis |
| 2010/0089591 | A1 | 4/2010 | Thomson et al. |
| 2012/0080198 | A1 | 4/2012 | Lembcke |
| 2012/0217021 | A1 | 8/2012 | Cravatte et al. |
| 2012/0305243 | A1 | 12/2012 | Hallundbaek et al. |
| 2013/0168099 | A1 | 7/2013 | Themig |
| 2014/0116714 | A1 | 5/2014 | Jefferies |
| 2015/0300136 | A1 | 10/2015 | Jefferies et al. |
| 2015/0322753 | A1 | 11/2015 | Zimmerman, Jr. |
| 2016/0061012 | A1 | 3/2016 | Zimmerman, Jr. |

OTHER PUBLICATIONS

International Search Report and Written Opinion PCT/US2015/029027 dated Aug. 5, 2015.

DURABLE DART PLUNGER

CROSS-REFERENCE TO RELATED APPLICATIONS

This application is a Continuation of U.S. patent application Ser. No. 15/396,188, filed Dec. 30, 2016, titled DURABLE DART PLUNGER, which is a Continuation-in-Part application of U.S. patent application Ser. No. 14/472,044, now U.S. Pat. No. 9,976,548, titled "Plunger Lift Assembly with an Improved Free Piston Assembly", filed Aug. 28, 2014 the entire content of which is expressly incorporated herein by reference thereto.

FIELD OF INVENTION

This invention relates to a plunger for moving liquids upwardly in a hydrocarbon well. In its first part, the invention relates to an improved free piston plunger assembly. In its second part, the invention relates to a one-piece, internal by-pass valve plunger assembly and more particularly to a durable dart plunger. The invention also relates to methods for increasing the productivity of oil and gas wells using a durable dart plunger.

BACKGROUND OF THE INVENTION

A plunger lift assembly and method for using such an assembly is disclosed in U.S. Pat. Nos. 6,467,541 and 6,719,060, which are incorporated herein by reference in their entirety.

There are many different techniques for artificially lifting formation liquids from hydrocarbon wells. Reciprocating sucker rod pumps are the most commonly used because they are the most cost effective, all things considered, over a wide variety of applications. Other types of artificial lift include electrically driven down hole pumps, hydraulic pumps, rotating rod pumps, free pistons or plunger lifts and several varieties of gas lift. These alternate types of artificial lift are more cost effective than sucker rod pumps in the niches or applications where they have become popular. One of these alternative types of artificial lift is known as a plunger lift, which is basically a free piston that moves upwardly in the well to move formation liquids to the surface. Typically, plunger lifts are used in gas wells that are loading up with formation liquids thereby reducing the amount of gas flow. A free piston should be understood to be a piston that is not attached to a reciprocating member, but rather relies on fluids and fluid pressure to move the piston components.

Gas wells reach their economic limit for a variety of reasons. A very common reason is the gas production declines to a point where the formation liquids are not readily moved up the production string to the surface. Two phase upward flow in a well is a complicated affair and most engineering equations thought to predict flow are only rough estimates of what is actually occurring. One reason is the changing relation of the liquid and of the gas flowing upwardly in the well. At times of more-or-less constant flow, the liquid acts as an upwardly moving film on the inside of the flow string while the gas flows in a central path on the inside of the liquid film. The gas flows much faster than the liquid film. When the volume of gas flow slows down below some critical values, or stops, the liquid runs down the inside of the flow string and accumulates in the bottom of the well.

If sufficient liquid accumulates in the bottom of the well, the well is no longer able to flow because the pressure in the reservoir is not able to start flowing against the pressure of the liquid column. The well is said to have loaded up and died. Years ago, gas wells were plugged much quicker than today because it was not economic to artificially lift small quantities of liquid from a gas well. At relatively high gas prices, it is economic to keep old gas wells on production. It has gradually been realized that gas wells have a life cycle that includes an old age segment where a variety of techniques are used to keep liquids flowing upwardly in the well and thereby prevent the well from loading up and dying.

There are many techniques for keeping old gas wells flowing and the appropriate one depends on where the well is in its life cycle. For example, the first technique is to drop soap sticks into the well. The soap sticks and some agitation cause the liquids to foam. The well is then turned to the atmosphere and a great deal of foamed liquid is discharged from the well. Later in its life cycle, when soaping the well has become much less effective, a string of 1" or 1½" tubing is run inside the production string. The idea is that the upward velocity in the small tubing string is much higher which keeps the liquid moving upwardly in the well to the surface. A rule of thumb is that wells producing enough gas to have an upward velocity in excess of 10'/second will stay unloaded. Wells where the upward velocity is less than 5'/second will always load up and die. As some stage in the life of a gas well, these techniques no longer work and the only approach left to keep the well on production is to artificially lift the liquid with a pump of some description. The logical and time tested technique is to pump the accumulated liquid up to the tubing string with a sucker rod pump and allow produced gas to flow up the annulus between the tubing string and the casing string. This is normally not practical in a 2⅞" tubingless completion unless one tries to use hollow rods and pump up the rods, which normally doesn't work very well or very long. Even then, it is not long before the rods cut a hole in the 27/8" string and the well is lost. In addition, sucker rod pumps require a large initial capital outlay and either require electrical service or elaborate equipment to restart the engine.

Free pistons or plunger lifts are a common type of artificial pumping system to raise liquid from a well that produces a substantial quantity of gas. Conventional plunger lift systems comprise a piston that is dropped into the well by stopping upward flow in the well, as by closing the wing valve on the well head. The piston is often called a free piston because it is not attached to a sucker rod string or other mechanism to pull the piston to the surface. When the piston reaches the bottom of the well, it falls into the liquid in the bottom of the well and ultimately into contact with a bumper spring, normally seated in a collar or resting on a collar stop. The wing valve is opened and gas flowing into the well pushes the piston upwardly toward the surface, pushing liquid on top of the piston to the surface. Although plunger lifts are commonly used devices, there is as much art as science to their operation.

A major disadvantage of conventional plunger lifts is the well must be shut in so the piston is able to fall to the bottom of the well. Because wells in need of artificial lifting are susceptible to being easily killed, stopping flow in the well has a number of serious effects. Most importantly, the liquid on the inside of the production string falls to the bottom of the well, or is pushed downwardly by the falling piston. This is the last thing that is desired because it is the reason that wells load up and die. In response to the desire to keep the well flowing when a plunger lift piston is dropped into the well, attempts have been made to provide valved bypasses through the piston which open and close at appropriate times. Such devices are to date quite intricate and these attempts have so far failed to gain wide acceptance.

Recent development of multi-part plungers which may be dropped into a well while formation contents are flowing upwardly in the well as shown in U.S. Pat. Nos. 6,148,923, 6,209,637 6,467,541, 6,719,060 and 7,383,878. In the most recent development, as taught in currently pending parent application Ser. No. 14/472,044, a flow restriction member is releasably retained by a sleeve member such that the flow restriction member is not released from the sleeve member solely by the force of gravity. As will be more fully appreciated by the description of the invention below, if the flow restriction member prematurely releases from the sleeve member, such as by a sudden decrease in fluid pressure ("lift"), the sleeve and flow restriction member will separately drop in the well until at some point they are reunited and begin the upward journey once again. In many instances, the separate free piston components are not reunited until they reach the bottom of the well at which time the process starts once again, thus losing valuable time and exposing the well to potential fluid pressures that may cause the well to stop flowing.

In some of the prior art devices utilizing such a separate free piston assembly, the components are latched together before beginning the lift portion of the process. Such latching presents problems that are overcome by the assembly of the parent invention Ser. No. 14/472,044. Specifically, the latching requires that the flow restriction member be captured by a mechanical structure that hold the flow restriction member in place during the lift. Such latching can be conveniently implemented at the bottom of the well where other structure is available to prevent movement of the flow restriction member while it is being latched, but just the opposite is true if the joinder of the flow restriction member and the sleeve member are being joined at a location above the bottom of the well. In such instances, the latching mechanism can actually interfere with the seating of the flow restriction member in the sleeve member and may result in the unwanted loss of time in joining the free piston members. The latching structure also tends to be cumbersome to install and frequently wears out prior to the useful life of the free piston assembly being completed.

For certain applications, the use of heavier, one-piece bypass plungers is preferred such as, for example, when sand causes premature wear on other types of plungers (e.g. padded plungers), in more dense fluid wells, during clean-out of a well, during operation in minimum bottom hole pressure, during operation in either high or low Gas Liquid Ratios (GLR). The use of one-piece bypass plungers circumvents long shut-in times. Recent development of such one-piece plungers is shown in U.S. Pat. Nos. 7,438,125 and 9,068,443 as well as U.S. Pat. Publication No. 2015-0300136. There remains, however, a need in the field for a simpler design single piece bypass plunger with fewer components that can fail, a plunger that can fall even faster, and lifts a larger volume of fluids per run.

The current invention pertains to a one-piece, internal by-pass valve durable dart plunger that falls faster, produces more fluids and has a clutch assembly (also referred to here as spring loaded retention assembly (or grappler)) that is more durable and that can also be replaced when worn out.

SUMMARY OF THE INVENTION

The current invention provides an improved single piece durable dart plunger having a spring loaded retention assembly that is replaceable when necessary.

The current invention provides a bypass dart plunger having a dart body with an upper end and a lower end, a pin positioned within the dart body, such that the pin is movable between an open and a closed position, a sleeve configured to fit into the dart body such that the sleeve has a flow passage extending longitudinally therethrough and a valve seat for receiving the pin to close the flow passage, one or more flow ports extending through the dart body and in communication with the flow passageway in the sleeve when the pin is in the open position, and a clutch assembly comprising a plurality of clutch mechanisms (grapplers) to hold the pin in the open or in the closed position mode, such that each of the clutch mechanisms includes a retention means, a biasing means and a fastener means, such that the biasing means biases the retention means into gripping engagement with the pin.

Also provided are embodiments wherein the lower end of the dart body of the bypass dart plunger described supra, further includes a nose piece, such that the one or more flow ports are located on the nose piece. The nose piece could be an integral part of the dart body. The flow ports are cut at right angles with respect to the dart body and the number of the flow ports can vary between 1 and 5. The clutch mechanism on the bypass plunger can be situated on the nose piece and can be replaced when worn out with a new clutch mechanism. Also provided is an embodiment of the bypass dart plunger wherein the sleeve is affixed to the dart body by threads.

The current invention also provides a bypass dart plunger as described supra with a ball as a retention means, a resilient spacer or a spring as a biasing means and a socket screw as a fastener.

It is an objective of the current invention to further provide a clutch assembly for a plunger having a plurality of clutch mechanisms wherein each mechanism includes a retention means, a biasing means and a fastening means. The clutch assembly can be part of a single piece bypass dart plunger such that the retention means retains a dart of the single piece bypass dart plunger in either an open position or a closed position.

It is a further objective to provide a clutch assembly for a plunger having a plurality of clutch mechanisms including a retention means, a biasing means and a fastener means, such that the clutch assembly is part of a two piece ball and sleeve plunger assembly (Grappler Plunger) including a retention means that releasably retains a ball in a closed position blocking a flow passage that extends through the plunger sleeve.

The invention herein also provides a method for lifting fluids out of a hydrocarbon wellbore that includes providing a bypass dart plunger having a dart body; a pin positioned within said dart body, wherein the pin is movable between an open and a closed position; a sleeve configured to fit into the dart body such that the sleeve has a flow passage extending longitudinally therethrough and a valve seat for receiving the pin to close said flow passage when the pin is in the closed position; one or more flow parts extending through the dart body; and a clutch assembly comprising a plurality of clutch mechanisms (grapplers), wherein each of the clutch mechanisms includes a retention means, a biasing means for biasing the retention means into gripping engagement with the pin, and a fastener means, holding the pin in the closed position with said clutch assembly and preventing gas from flowing through said flow passage; and lifting fluids out of the wellbore by said bypass dart plunger. In an embodiment of the current invention, the method for lifting fluids further includes replacing the clutch assembly with a new clutch assembly (or grappler system), and reusing the bypass dart plunger with the new clutch assembly to lift fluids out of a hydrocarbon well.

The current invention also provides a method for lifting fluids out of a hydrocarbon wellbore such that the method includes the steps of providing a bypass dart plunger having a dart body; a pin positioned within said dart body, wherein the pin is movable between an open and a closed position; a sleeve configured to fit into the dart body such that the sleeve has a flow passage extending longitudinally therethrough and a valve seat for receiving the pin to close the flow passage when the pin is in the closed position; one or more flow parts extending through the dart body; and a clutch assembly comprising a plurality of clutch mechanisms, wherein each of the clutch mechanisms includes a retention means, a biasing means for biasing the retention means into gripping engagement with the pin, and a fastener means, holding the pin in the open position within the clutch assembly; and allowing gas to flow through the flow ports, around the pin, and through the flow passageway while the plunger falls in the wellbore.

DETAILED DESCRIPTION OF THE PREFERRED EMBODIMENTS

A. Improved Free Piston Assembly

Figure 1:
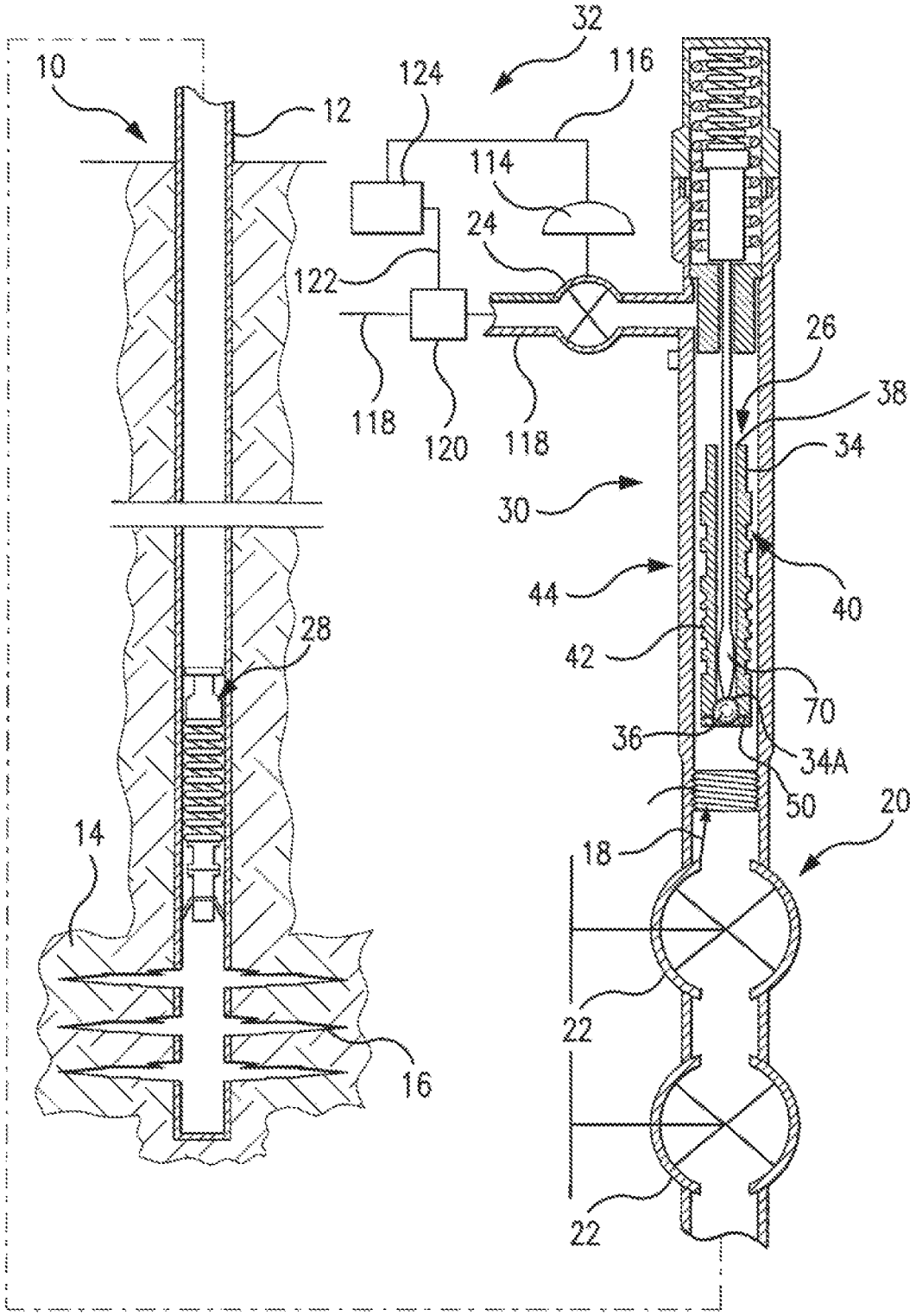
FIG. 1 is a schematic view of a well equipped with a plunger lift system that includes one embodiment of the improved free piston assembly of this invention, certain parts being broken away for clarity of illustration.

The multipart plunger embodiments shown in commonly assigned U.S. Pat. No. 6,467,541 has proven to be quite satisfactory for a wide range of applications where gas wells produce sufficient liquid that slows down gas production and ultimately kills the well. Experience and analysis resulted in two improvements being made in the operation of a multipart plunger. These improvements are disclosed in commonly assigned U.S. Pat. No. 6,719,060 and are described with more particularity below and in the specification of the U.S. Pat. No. 6,719,060.

In one embodiment of the plunger lift assembly used in combination with the improved free piston assembly of this invention, the technique used to separate and hold the plunger at the surface employs moving parts to receive and cushion the impact of the plunger as it arrives at the surface but employ no moving parts to hold the plunger in the well head. A separator rod is provided which the plunger sleeve slides over, thereby dislodging the flow restriction member and causing it to fall into the well. Flow from the well passes around and/or through the separator rod and the sleeve member, also referred to as the plunger sleeve. The separator rod and plunger sleeve include cooperating sections that produce a pressure drop sufficient to hold the plunger sleeve in the well head against the force of gravity. When flow through the well head is insufficient to hold the plunger sleeve against the force of gravity, the plunger sleeve falls into the well, couples with the flow restriction member at or near the bottom of the well and then moves upwardly to produce a quantity of formation liquid thereby unloading the well. Typically, the plunger sleeve is dropped into the well in response to closing of a valve at the surface that interrupts flow thereby momentarily reducing gas flow at the surface and substantially eliminating any pressure drop across the plunger sleeve. Various aspects of the separator rod and housing for the separator rod are shown and described in U.S. Pat. No. 6,719,060.

An important advantage of the separator rod used in combination with the improved free piston assembly of this invention is the plunger sleeve is dropped by momentarily shutting in a valve controlling flow from the well. This allows operation of the plunger lift without using natural gas as a power source for a holding device thereby eliminating the venting of methane to the atmosphere. It also eliminates a holding device which includes moving parts subject to malfunction or failure.

Major gas producing companies that operate large numbers of gas wells have gained considerable experience in keeping older gas wells flowing. Many of such companies use large numbers of plunger lifts and have devised sophisticated computer programs to determine when to drop conventional one-piece plungers into a well. It will be recollected that one-piece plunger are typically held at the surface until production falls off, whereupon the well is shut in, the plunger is released and the well remains shut in for a long enough time for the plunger to fall to the bottom of the well. The flow control valve is then opened and the well produces enough formation contents to drive the plunger to the surface, producing liquid along with gas and thereby unloading the well. The computer programs used to operate conventional one-piece plunger lift systems act in response to a wide variety of input information, e.g. flowing well head pressure or flow line pressure which are either the same or very close to the same, gas volume, pressure on the casing as opposed to pressure of gas flowing in the tubing and previous plunger speed as an indication of the liquid being lifted.

Although they can be made to work satisfactorily with multipart plungers, these conventional programs measure the wrong things to drop a multipart plunger sleeve into a well on an optimum basis. An ideal cycle for a multipart plunger is to lift a small quantity of liquid on each plunger trip. It is not desirable to lift no liquid because the plunger takes a beating when it enters the well head with no liquid in front of it—the piston velocity is too high and the spring assemblies in the well head take too much punishment. More importantly, if no liquid is being lifted, it is quite likely there is no liquid in the bottom of the well. When this happens, there is likely considerable damage done to the bumper assembly at the bottom of the well as may be imagined by considering the damage potential of a metal article weighing a few pounds falling at terminal velocity. When there is no liquid being lifted, the plunger should be dropped less frequently.

Conversely, if the plunger is lifting too large a quantity of liquid on each cycle, the productivity of the well is being unduly restricted. If the quantity of liquid becomes too large, there is a risk that plunger will not cycle and the well will be dead. When the quantity of liquid becomes larger than a small selected value, the plunger should be dropped more frequently. Thus, there is an ideal amount of liquid to be raised on each cycle and it is surprisingly small, something on the order of ⅛ to ⅛ barrel, depending on the flowing bottom hole pressure of the well and the flow line pressure the well is producing against. In normal situations, a preferred amount being lifted on each cycle of the plunger is on the order of about ⅙ barrel. Thus, by measuring what is important to the operation of a multipart piston of a plunger lift, improved operations result.

Referring to FIGS. 1-5, a hydrocarbon well 10 comprises a production string 12 extending into the earth in communication with a subterranean hydrocarbon bearing formation 14. The production string 12 is typically a conventional tubing string made up of joints of tubing that are threaded together. Although the production string 12 may be inside a casing string (not shown), it is illustrated as cemented in the earth. The formation 14 communicates with the inside of the production string 12 through perforations 16. As well be more fully apparent hereinafter, a plunger lift assembly 18 is used to lift oil, condensate or water from the bottom of the well 10 which may be classified as either an oil well or a gas well.

In a typical application of this invention, the well 10 is a gas well that produces some formation liquid. In an earlier stage of the productive life of the well 10, there is sufficient gas being produced to deliver the formation liquids to the surface. The well 10 is equipped with a conventional well head assembly 20 comprising a pair of master valves 22 and a wing valve 24 delivering produced formation products to a surface facility for separating, measuring and treating the produced products.

The plunger lift 18 of this invention comprises, as major components, a free piston 26, a lower bumper assembly 28 near the producing formation 14, a catcher assembly 30 and an assembly 32 for controlling the cycle time of the piston 26. The free piston 26 is of multipart design and includes a sleeve 34 and a flow restriction member 36 which is preferably a ball as shown in U.S. Pat. No. 6,467,541, the disclosure of which is incorporated herein by reference. The free piston 26 also includes retention means 50 for retaining the flow restriction member 36 in the interior of the sleeve 34 by supplying a force sufficient to overcome the force of gravity on said flow retention member 36. For purposes of this invention, the preferred flow restriction member 36 is a ball and therefore in some instances the terms are used interchangeably. It should, however, be understood that other embodiments of flow restriction members may be equally viable in the improved free piston assembly of this invention.

The sleeve 34 is generally cylindrical having an interior flow passage 38 and a seal arrangement 40 to minimize liquid on the outside of the sleeve 34 from bypassing around the exterior of the sleeve 34. The seal arrangement 40 may be of any suitable type, such as wire brush wound around the sleeve 34 providing a multiplicity of bristles or the like or may comprise a series of simple grooves or indentations 42. The grooves 42 work because they create a turbulent zone between the sleeve 34 and the inside of the production string 12 thereby restricting liquid flow on the outside of the sleeve 34. Sleeve 34 also includes a surface 34A against which the flow restriction member can nest when it is being retained in the interior opening to the sleeve 34.

As will be more fully apparent hereinafter, the flow restriction member 36, especially when configured as a ball, is first dropped into the well 10, followed by the sleeve 34. The ball 36 and sleeve 34 accordingly fall separately and independently into the well 10, usually while the well 10 is producing gas and liquid up the production string 12 and through the well head assembly 20. When the ball 36 and sleeve 34 reach the bottom of the well, they impact the lower bumper assembly 28 in preparation for moving upwardly. The lower bumper assembly 28 may be of any suitable design, one of which is illustrated in U.S. Pat. No. 6,209,637 and basically acts to cushion the impact of the ball 36 and sleeve 34 when they arrive at the bottom of the well 10.

An important feature of the plunger lift assembly is the catcher assembly 30 which has several functions, i.e. separating the ball 36 from the sleeve 34, retaining the sleeve 34 in the assembly 30 for a period of time and then dropping the sleeve 34 into the well 10. The catcher assembly 30 is more fully described in U.S. Pat. No. 6,719,060 which has been previously incorporated by reference. The catcher assembly 30 comprises an outer housing or catch tube 44 which provides an outlet for formation products and a shoulder for stopping the upward movement of the sleeve 34 and provides an inner surface having a seat 34A in which the flow restriction member 36 can nest.

Inside the housing 44 is a separation rod assembly for cushioning the impact of the sleeve 34, and to some extent of the ball 36, when the free piston 26 reaches its upper limit of travel. The sleeve 34 ultimately passes onto the lower end of the separator rod 70 thereby overcoming the retaining force of the retention means 50 and dislodging the ball 36 and allowing it to fall immediately back into the production string 12.

An important feature of this invention is that the free piston assembly 26 includes retention means 50 to hold the flow restriction member 36 in the sleeve 34 to overcome the force of gravity placed on such flow restriction member. Retention means 50 can take a number of design forms, however, the preferred design is a plurality of ball shaped retractable pressure members 80 protruding into the interior of the sleeve and configured to protrude inwardly from apertures 82 communicating with the inner surface of the sleeve member 34. The inward bias or pressure is supplied by spring means 84 contacting the outer surface of each of the ball shaped retractable pressure members 80. The spring means 84 are held in place by a retaining ring 86 that is sized to fit into a groove 88 in the exterior surface of the sleeve 34.

Figure 4:
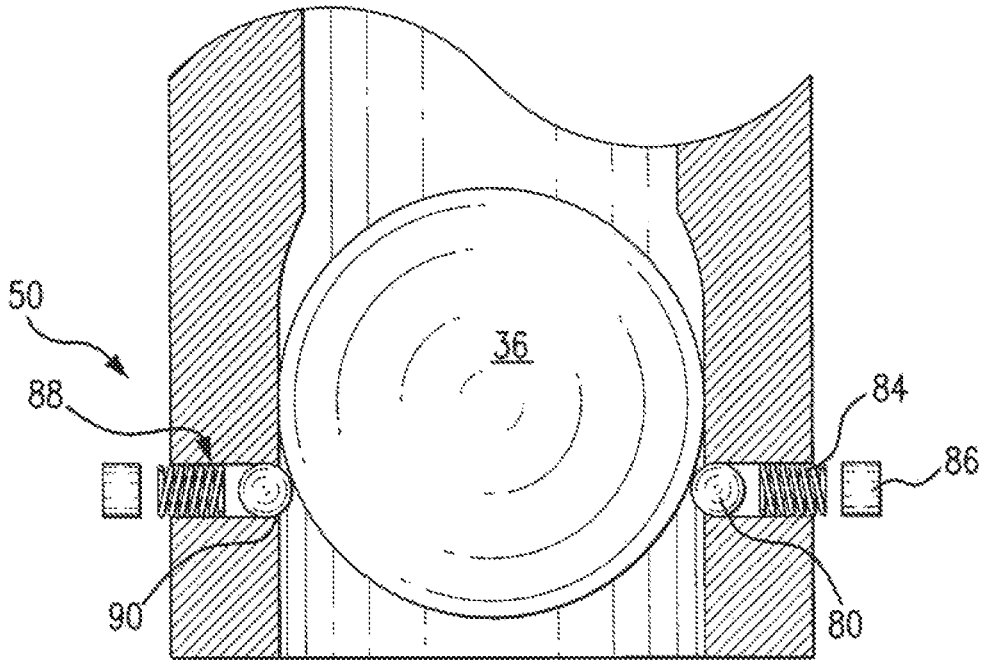
FIG. 4 is an exploded cross sectional view of the sleeve member, flow restriction member and spring loaded retention assembly with the flow restriction member being held in place by the spring loaded retention assembly.
Figure 5:
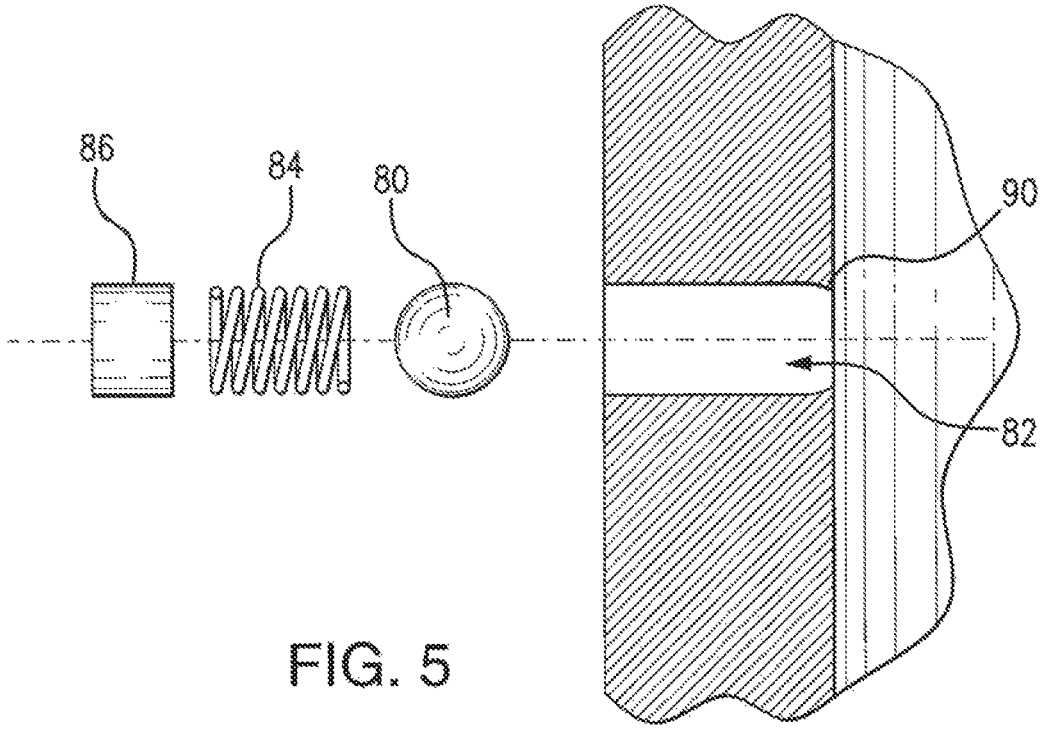
FIG. 5 is an exploded cross sectional view of the retention assembly of FIG. 4.
Figure 6:
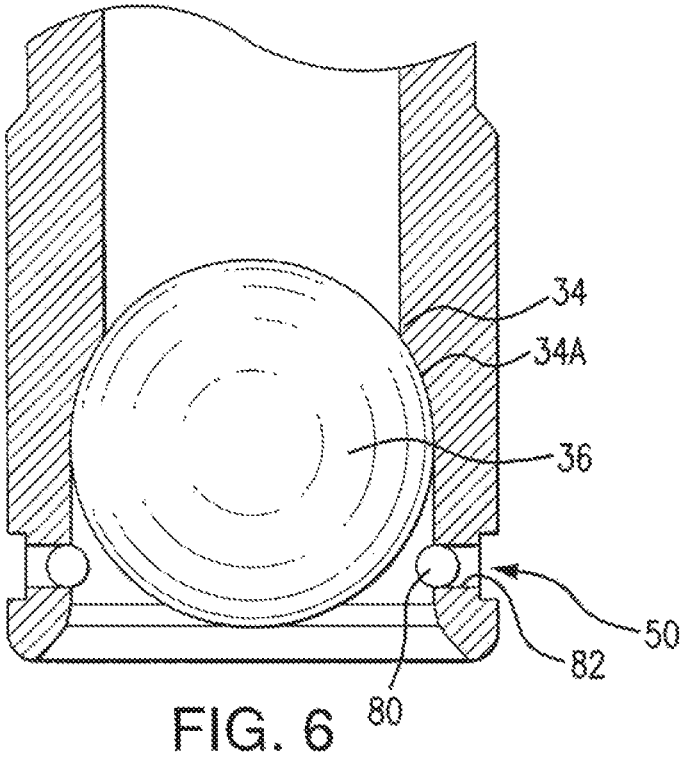
FIG. 6 is a cross sectional view of the sleeve member, flow restriction member and spring loaded retention means of this invention showing the flow restriction member seated in the sleeve member and being axially removed from the retention means.
Figure 7:
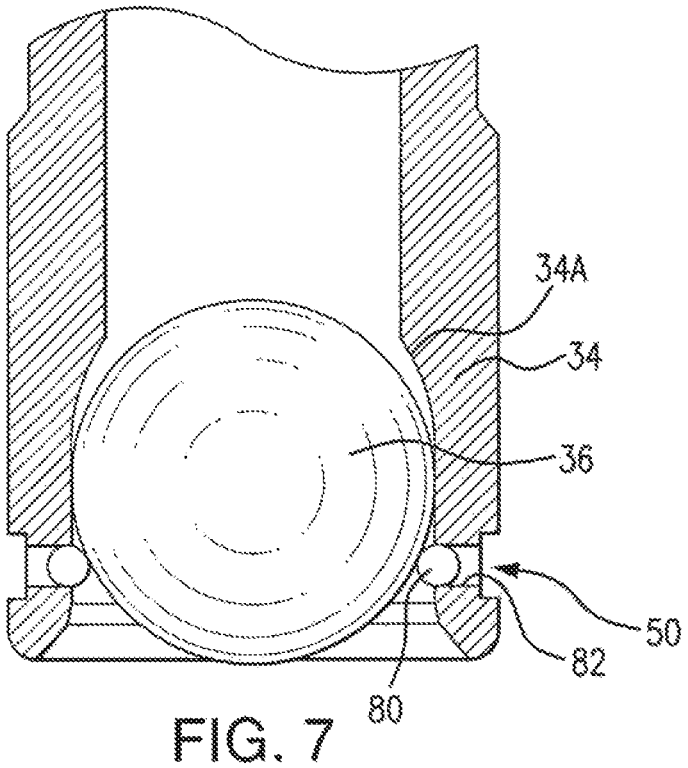
FIG. 7 is the same cross sectional view as shown by FIG. 6 but with the flow restriction member being unseated and being retained in the sleeve member by spring loaded retention means.
Figure 8:
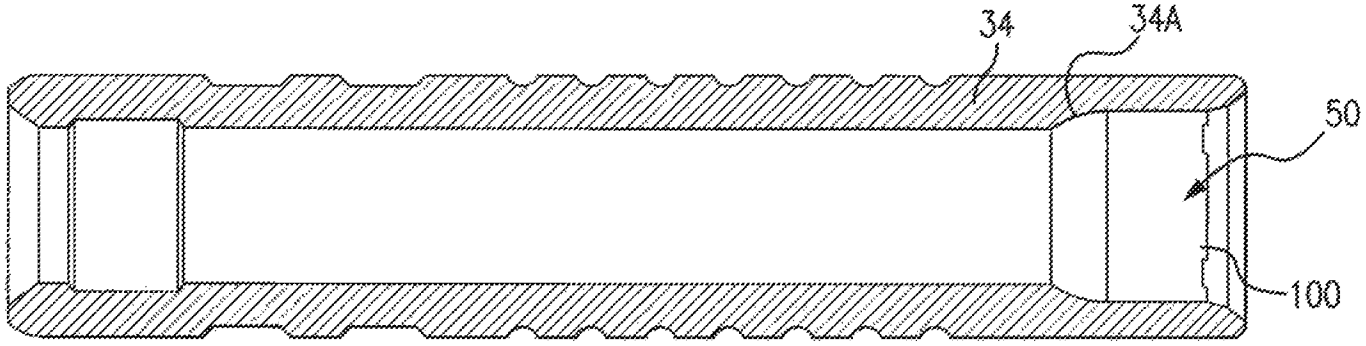
FIG. 8 is a cross sectional view of one embodiment of the free piston assembly of this invention including the sleeve member and the retention member in the form of a raised lip.
Figure 8A:
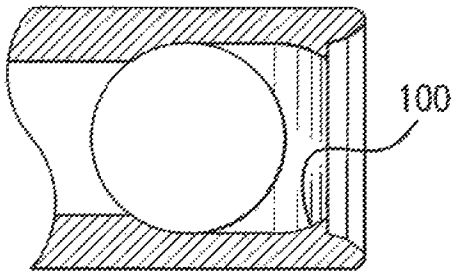
FIG. 8A is a cross sectional view of a portion of the embodiment of the free piston assembly of FIG. 8 showing the sleeve member with the flow restriction device seated and the retention means spaced apart from any physical contact with the flow restriction device.
Figure 8B:
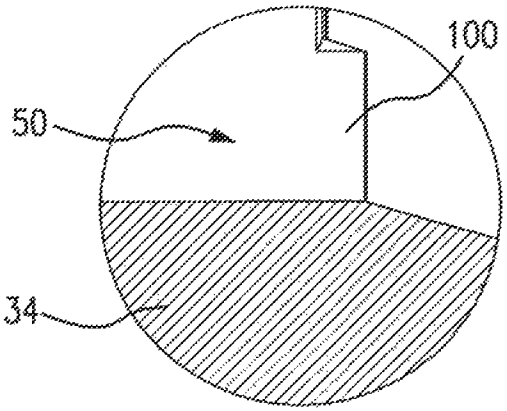
FIG. 8B is a cross sectional view of one embodiment of the raised lip retention means of this invention.
Figure 8C:
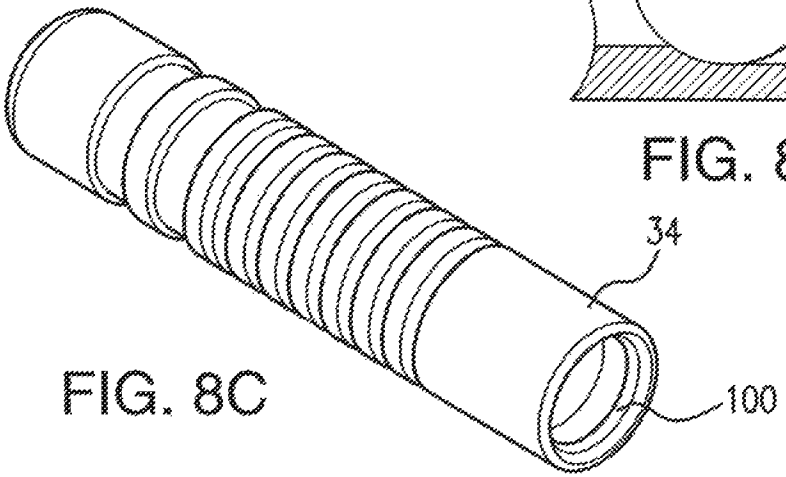
FIG. 8C is a schematic view of the sleeve member of this invention with the raised lip retention means embodiment of FIG. 8B.
Figure 9:
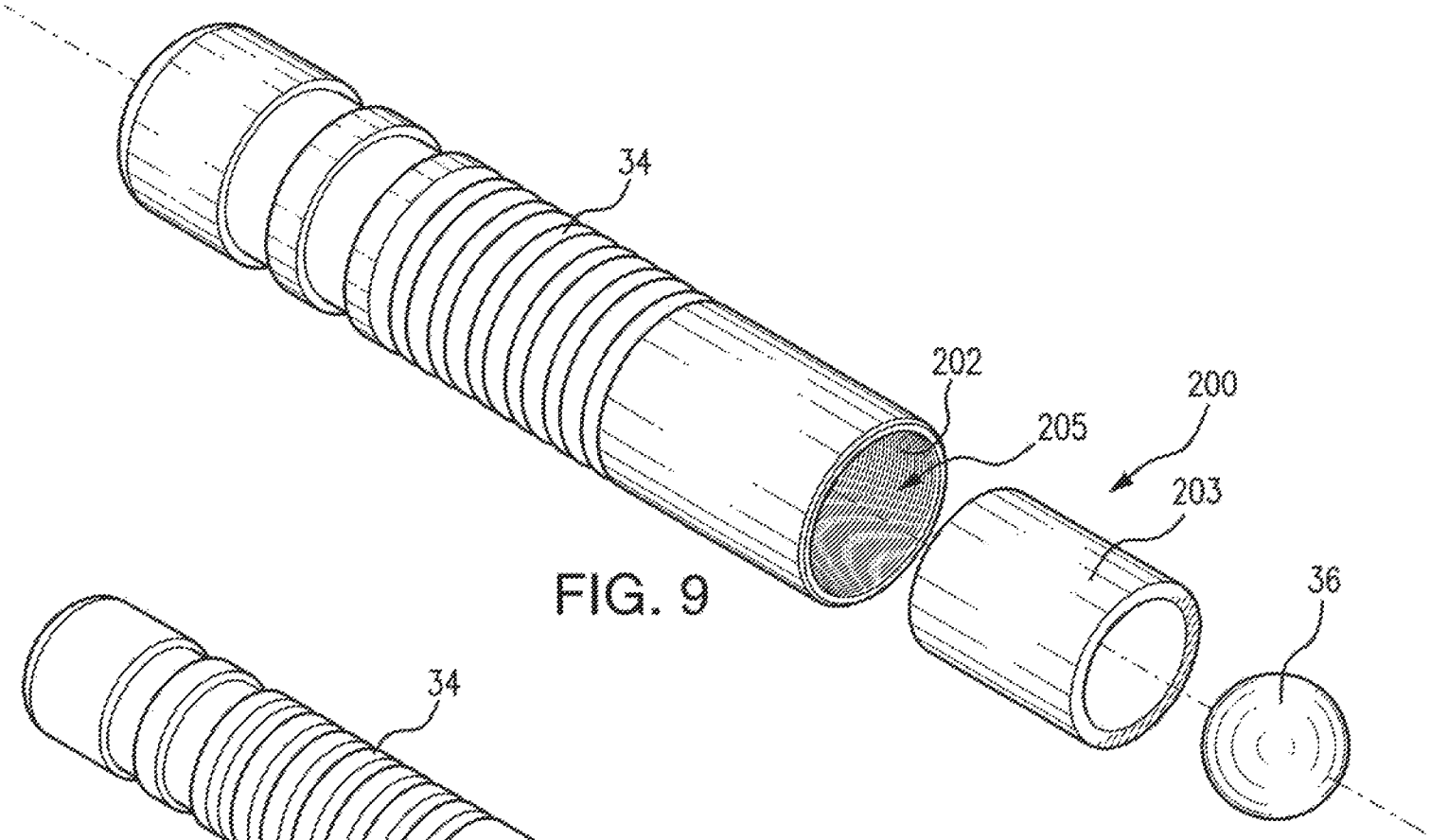
FIG. 9 is an exploded schematic view of an alternative embodiment of the retention means of this invention showing a retention sleeve as the retention means.
Figure 9A:
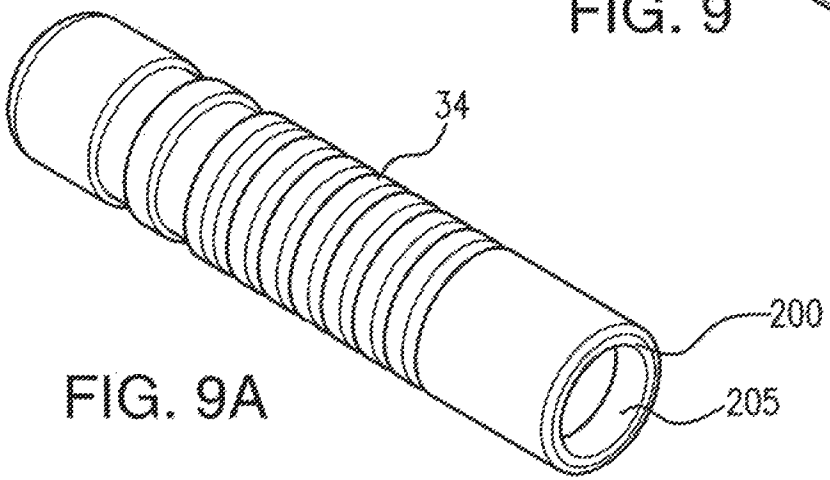
FIG. 9A is a schematic view of the sleeve member of this invention with the retention sleeve embodiment of FIG. 9.
Figure 10:
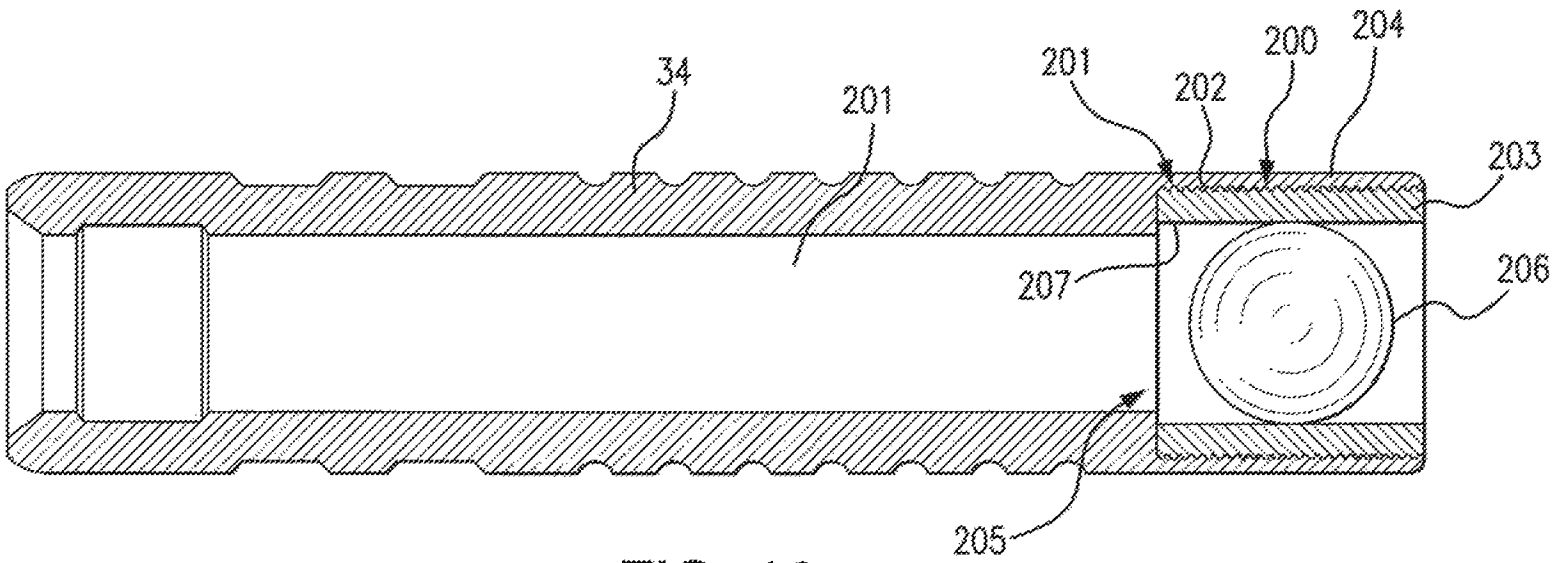
FIG. 10 is a cross sectional view of the retention sleeve embodiment of FIG. 9 showing the flow restriction member being retained by a retention sleeve.

As can be more clearly seen in FIGS. 4-5, in one preferred embodiment of the invention a groove 88 is cut into the exterior surface of sleeve 34. A series of apertures 82 are cut into the lower surface of the groove such that the apertures 82 communicate directly with the interior surface of the sleeve 34. The apertures 82 are formed such that the diameter of the portion of each aperture closest to the interior of the sleeve is smaller that the diameter of the retractable ball member, thus providing a seat 90 for the retractable pressure members 80 and preventing the pressure members 80 from falling into the interior of the sleeve member 34. The pressure members 80 are biased toward the interior of the sleeve member 34 by spring means 84, which can be spiral springs or leaf springs. The retractable ball members 80 are movable between a fully biased position in which at least a portion of the ball member 80 protrudes into the interior of the sleeve member to a retracted position in which the interior most surface of the ball member 80 is even with the interior surface of the sleeve member and does not provide a retaining force on the flow restriction member and do not prevent the flow restriction member from fall down the well bore. The spring means 84 are in contact with the exterior surface of the retractable pressure members 80 such that the pressure members 80 protrude into the interior of the sleeve member in order to prevent the flow restriction member 36 from escaping the sleeve member 34 based on the force of gravity. The spring means 84 and pressure members 80 are mounted in the apertures 82 in the groove 88, and in turn are held in place by a retention member 86, typically in the form of a retention ring 86.

In the preferred embodiment of this invention the retention ring is made from a number of materials that are well known to persons of ordinary skill in the art and include chrome steel, titanium, stainless steel, ceramic, tungsten carbide, silicone nitrate, plastic, and rubber or any other functionally effective elastomeric. On the other hand, the sleeve member and flow retention member are made from materials selected from the group consisting of stainless steel, chrome steel, cobalt, ceramic (zirconium), tungsten carbide, silicon nitride, and titanium alloys. In the most preferred embodiments of this invention the sleeve member and flow retention member are made from one or more of the materials list hereinabove and having a density of less than about 0.25 pounds per cubic inch and a tensile strength of at least 90,000 psi.

In practice, the groove 88 for the retention means 50 is located on the sleeve 34 at a position such a shown in FIG. 4. As can be seen, a substantial portion of the entire flow restriction member 36 is held inside the sleeve member 34 although the only requirement is that the flow restriction member 36, regardless of its shape, be maintained in the sleeve member until physically released by the separation rod.

Referring to FIG. 1, the piston sleeve 34 is dropped into the production string 12 simply by momentarily closing the wing valve 24. This may be automated by providing a motor operator 114 and controlling the operator 114 by an electrical signal delivered through a wire 116. Although any suitable controller may be used to cycle the plunger lift of this invention, a preferred technique is to measure or sense liquid delivered through a flow line 118 leading from the wellhead 20 and momentarily close the valve 24 in response to a parameter related to the amount of liquid flowing in the flow line 118.

Operation of the plunger lift of this invention should now be apparent. During upward movement of the piston 26 toward the well head 20, production through the wing valve 24 is mainly dry gas. As the piston 26 approaches the well head, there is often a small slug or batch of liquid that passes through the wing valve 24 which may cause the meter 120 or detector 125 to detect the arrival of a liquid slug at the surface. If the amount of liquid is very small, it can be readily identified and disregarded by the controller 124. As the piston 26 nears the well head 20, it pushes a quantity of liquid above it through the well head and the wing valve 24 to be measured or sensed by the meter 120 or the detector 125. If the plunger lift and improved free piston assembly are working satisfactorily, the volume immediately above the piston 26 is a more-or-less solid stream of liquid, the volume or time of discharge of which is measured by the meter 120 or the detector 125.

When the piston 26 reaches the separation rod 62, the ball 36 is dislodged from the piston 26 and falls immediately back into the production string 12. The sleeve 34 slips over the separation rod 62 and strokes the anvil. Any liquid remaining in the well head is driven through the flow line 118 by formation gas. Gas flowing upwardly in the flow paths around the separation rod 62, sleeve 34 and housing 44 creates a pressure drop across the sleeve 34 causing it to stay on the rod 62 against the effect of gravity. When the controller 124 determines that it is time to drop the sleeve 34 and initiate another plunger cycle, a signal is delivered on the wire 116 to energize the motor operator 114 and momentarily close the wing valve 24. This causes the pressure drop across the sleeve 34 to decrease, so that upward force acting on the sleeve 34 drops and the sleeve 34 falls into the production string.

It can also be seen that cycling the sleeve 34 in response to the amount of liquid delivered during the surface allows a relatively small volume of liquid to be produced during each cycle of the piston 26. This prevents damage to the rod assembly 60 and to the downhole bumper assembly 28 caused by the production of no liquid and allows maximum trouble free gas production by keeping the well unloaded to as great an extent as reasonable.

B. Durable One-Piece Dart Plunger

The current invention also provides an internal by-pass valve dart plunger that falls faster, produces more fluids and has a clutch assembly that is durable and can be replaced when worn out. Referring to the drawings, and in particular to FIGS. 11-13B, a dart plunger with a simple one-piece design is presented. An alternate embodiment of the dart body, showing a two-piece design with a nose piece that is detachable, is presented in FIGS. 14A-C and 16B.

Figure 11:
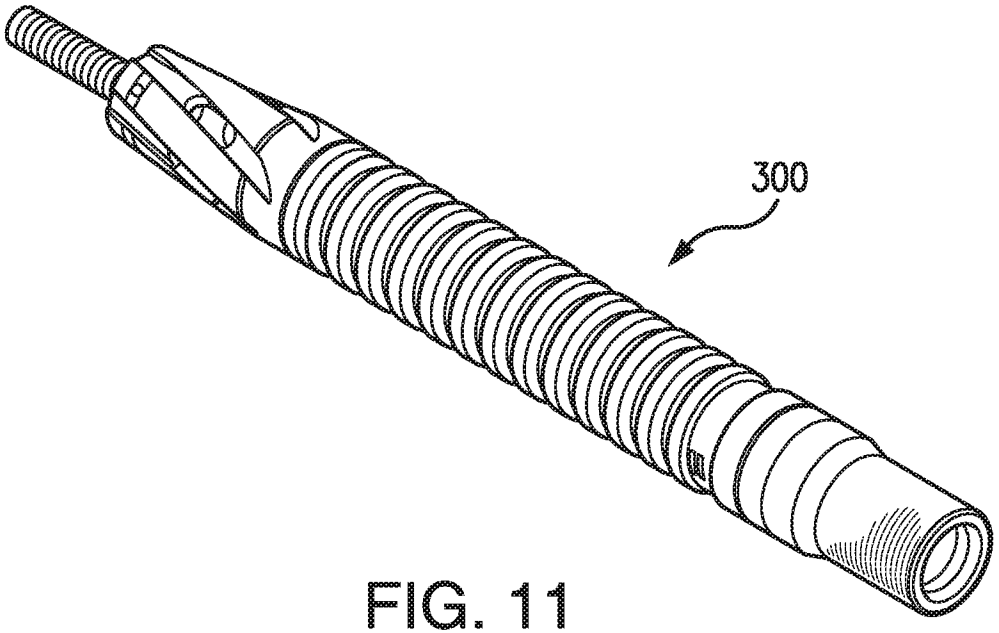
FIG. 11 is a schematic view of an embodiment of a one-piece durable dart plunger in accordance with the current invention, wherein the pin is in the open position.
Figure 12:
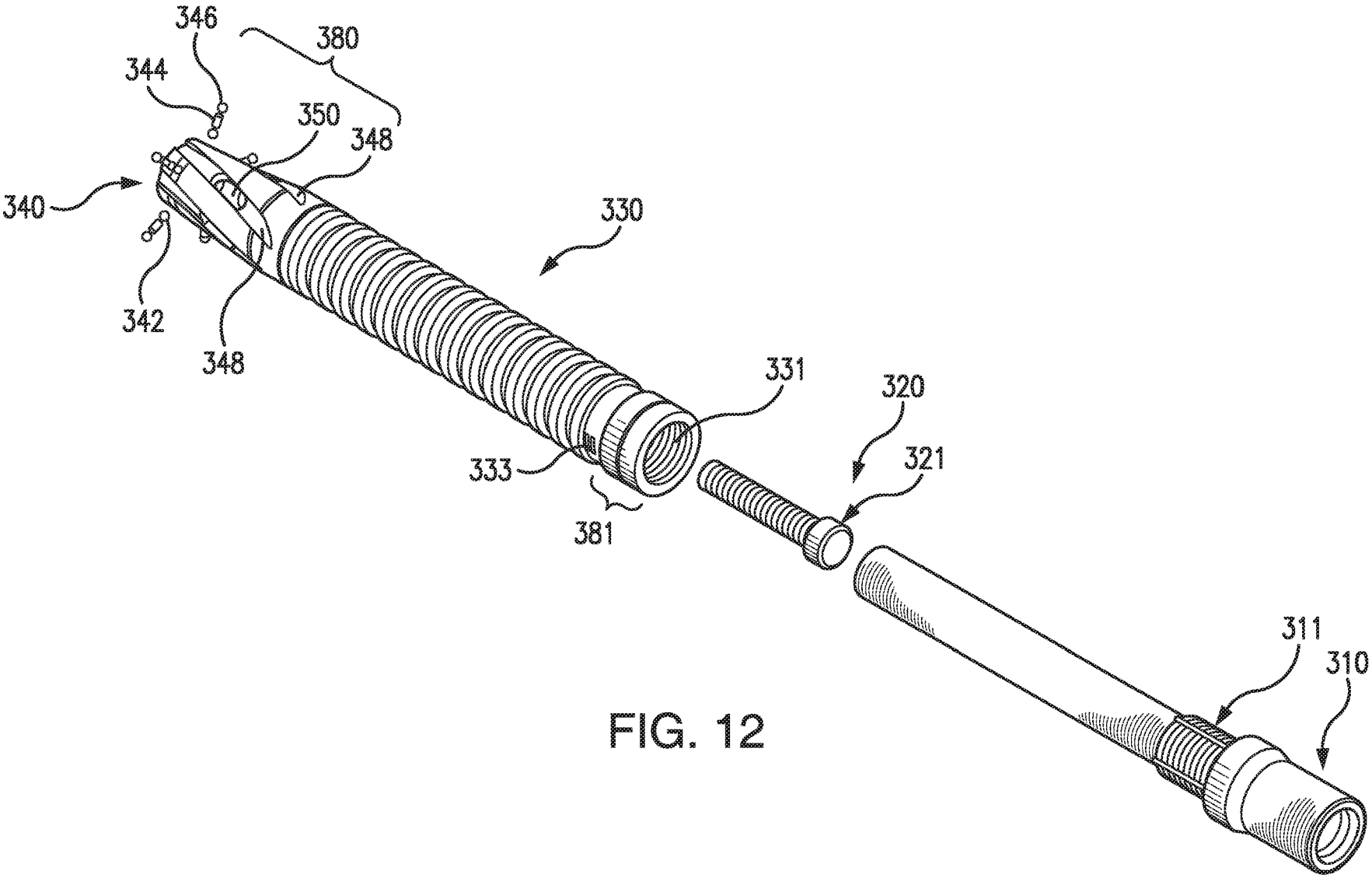
FIG. 12 is an exploded schematic view of the durable dart plunger of FIG. 11, depicting dart plunger sleeve, pin, dart body with one of the several chokes, the clutch assembly comprising spacers, balls and socket screws and a blown up portion of the etching location that serves as a marker for when the clutch assembly was manufactured. In this embodiment the nose is an integral part of the body.

Referring to FIGS. 11 and 12, durable dart plunger 300 comprises dart plunger sleeve 310, pin 320 (also referred to as dart 320), dart body 330, one or more chokes 350 and clutch assembly 340. Dart body 330 is a cylindrical one piece body that has an upper end 381 and a lower end or nose 380 and an internal flow passageway 382. Nose 380 comprises clutch assembly 340 and either one or a plurality of helical grooves housing bypass port or choke 350. As described hereinafter for a preferred embodiment, nose 380 is integral to body 330. Having the nose as an integral part of body 330 avoids connections that are prone to failure or leaks. The number and sizes of the chokes (flow ports) can also vary. It is contemplated that the number of chokes per dart plunger can be 1 or up to 5 chokes. The size of the choke controls the speed of descent of the plunge. The larger the bypass choke is, the faster the dart plunger drops in the well. Choke dimensions may vary. For example, a choke may be 0.375" in diameter and may have a length of 0.91", 1.17", 1.47", or 1.73", etc. as appreciated by a person of skill in the art. Therefore, depending on the well conditions, an operator can choose between a variety of plungers with different choke sizes. The operator can also choose between heavier or lighter plungers depending either on the length of the plunger body or on the material used so as to further optimize for a given well condition. Different materials used may include 4140 steel or stainless steel or titanium which is much lighter. The plungers may also be coated with Nickel Boron or Electroless-Nickel for increased corrosion-resistance and longevity. Also contemplated in this invention, is the provision of a replacement kit for clutch assembly 340 (also referred to as a Grappler Rebuilt kit) which includes one or more of the following, a grappler ball, spring or Buna Rubber and set screw. The kit may include an instruction manual or user guide.

Figure 3:
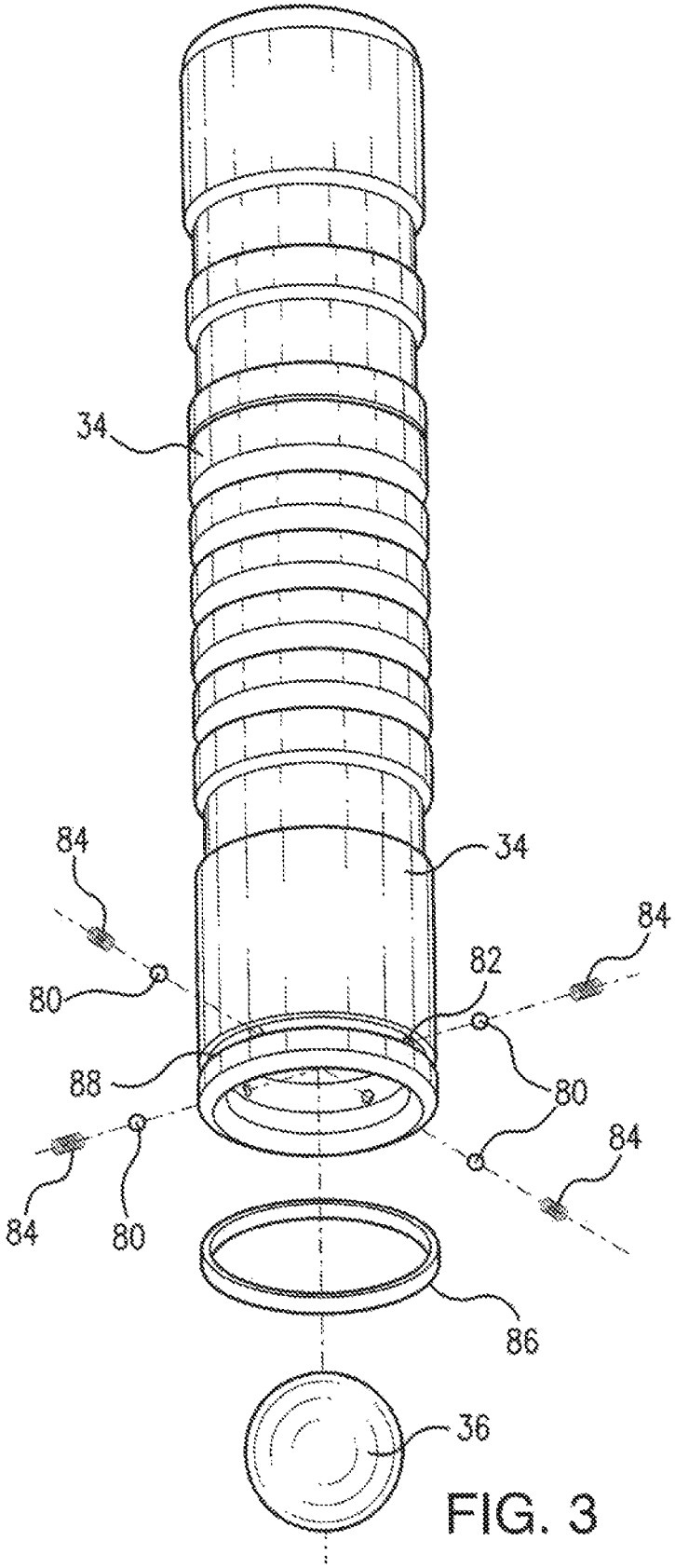
FIG. 3 is a cross sectional view of the sleeve member, flow restriction member and spring loaded retention means embodiment of this invention.
Figure 2:
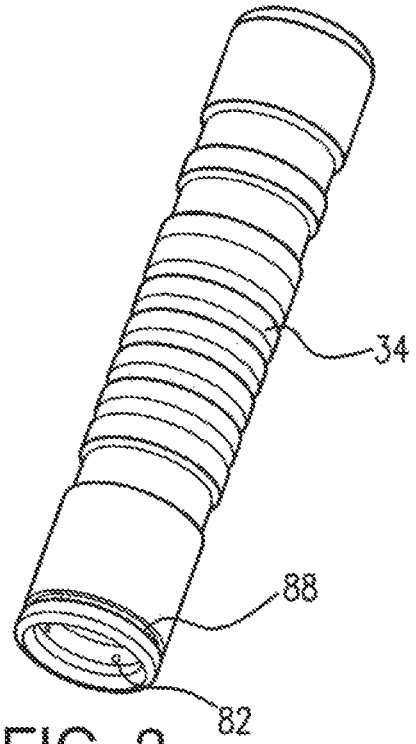
FIG. 2 is a schematic view of the sleeve member of this invention with the retention assembly in place but without the restriction member.
Figure 13A:
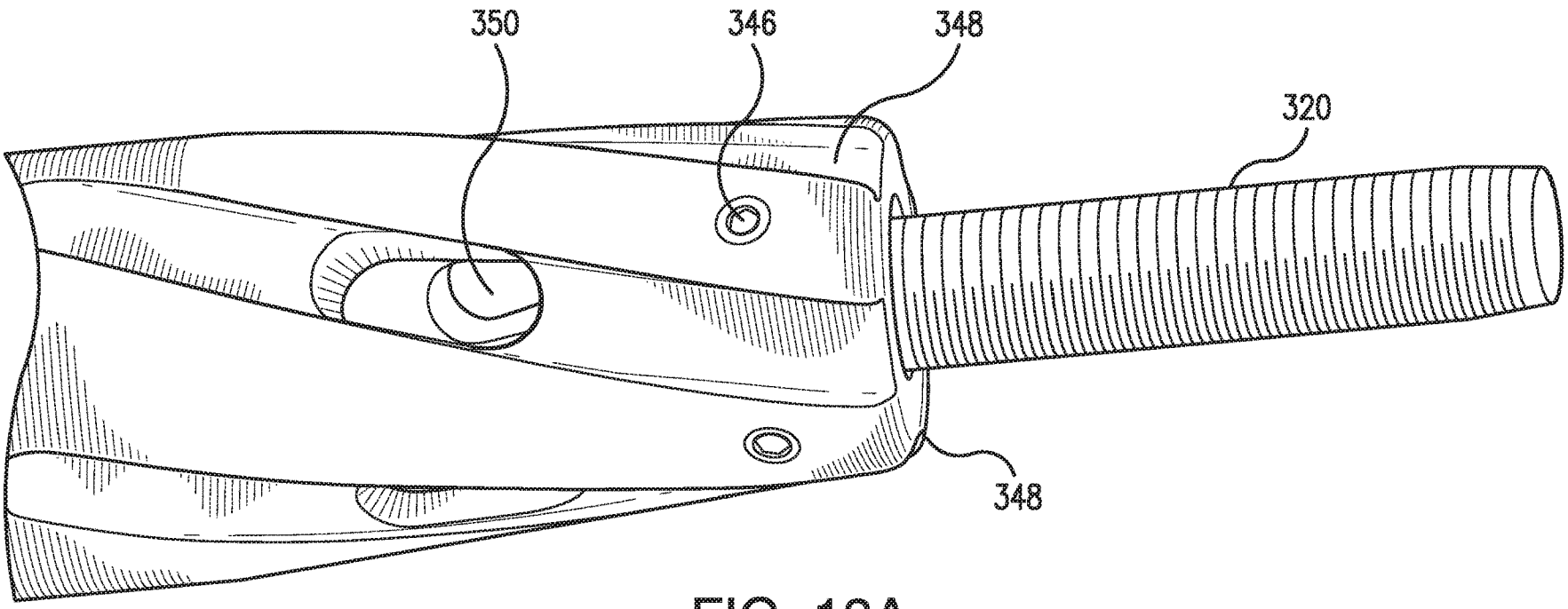
FIG. 13A is a schematic view of the nose part of the one piece dart plunger in accordance with the current invention showing the pin fully extended in the open bypass position. Also shown is a socket screw of the clutch mechanism and the helical grooves situating the chokes/ports.
Figure 13B:
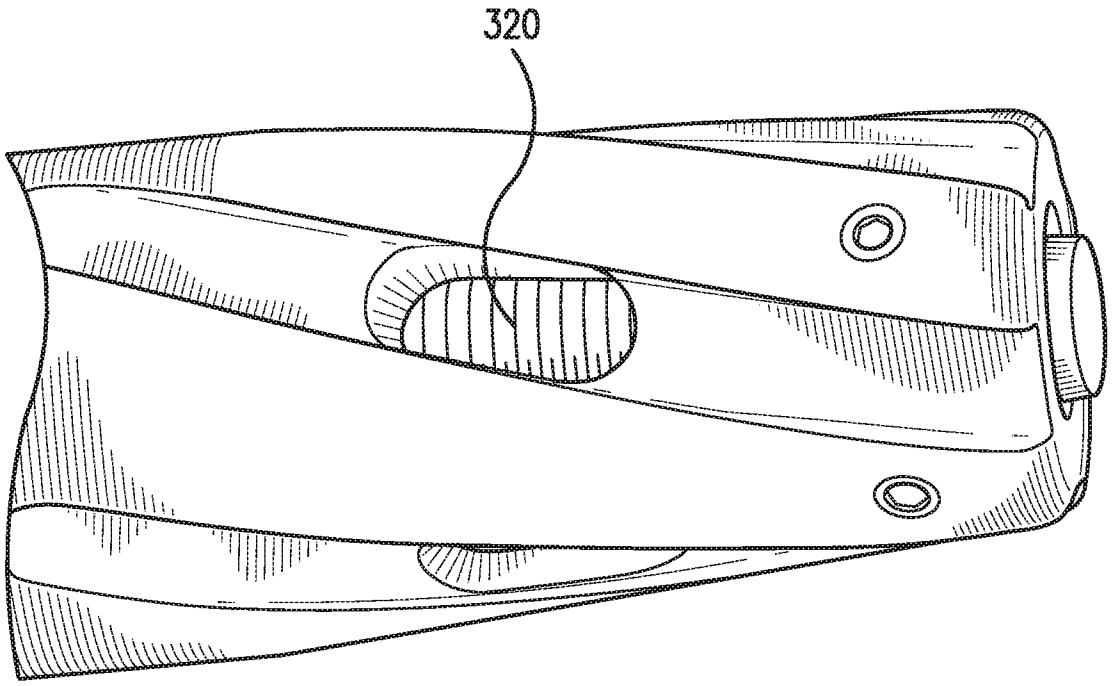
FIG. 13B is a schematic view of the nose part of FIG. 13A when the pin is in the closed position. The body of the pin is shown through the choke.
Figure 14A:
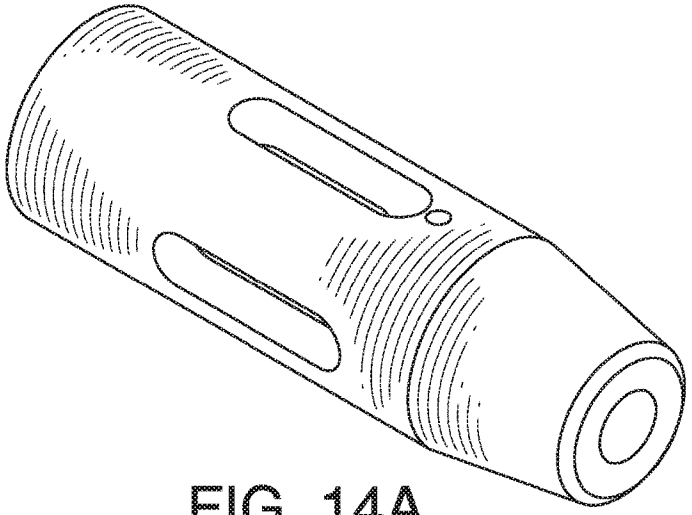
FIG. 14A depicts a perspective view of an alternate embodiment of the nose of a dart plunger body in accordance with the current invention. In this design, a ball inside the nose cage (instead of a choke) is contemplated.
Figure 14B:
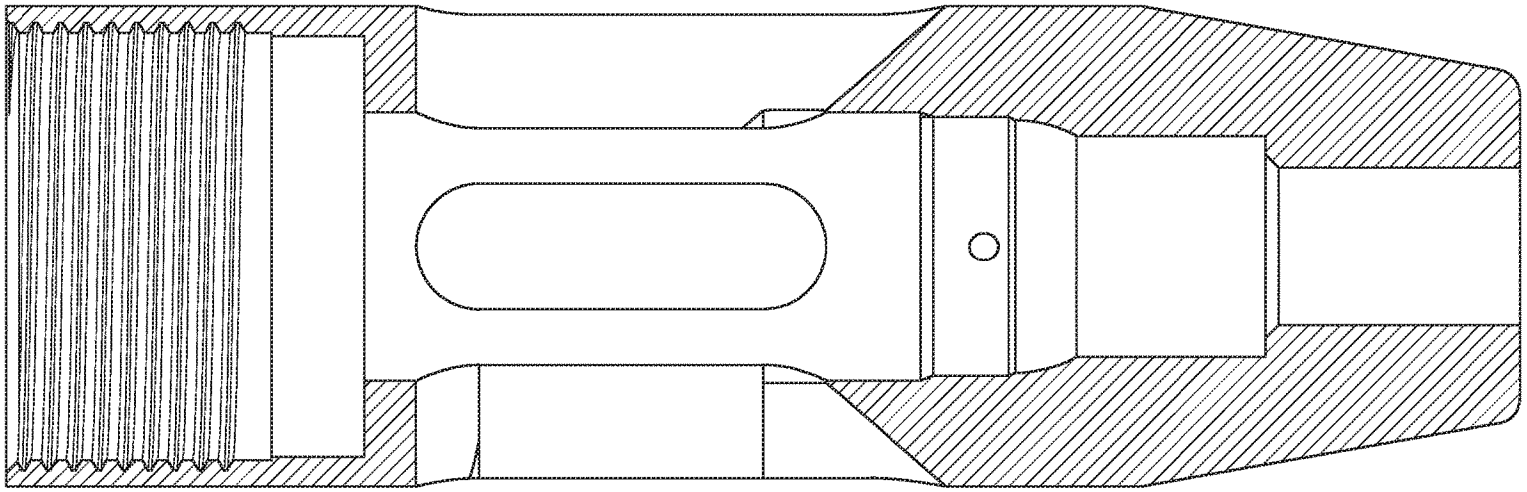
FIG. 14B is a cross sectional view of the body of FIG. 14A.
Figure 14C:
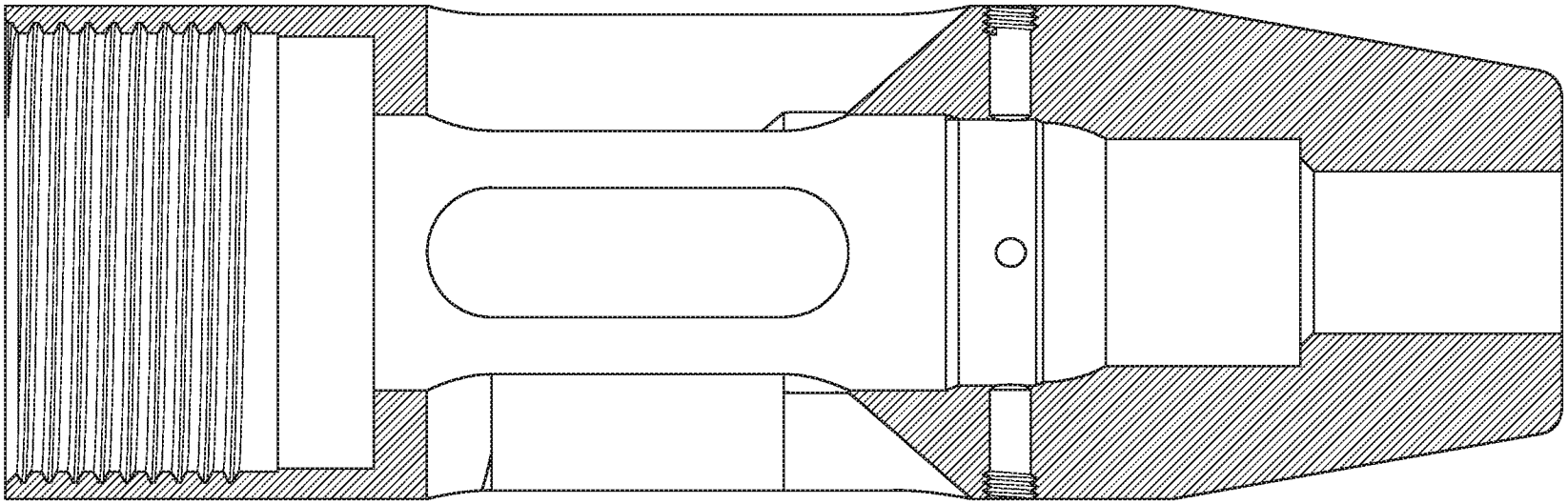
FIG. 14C is a cross sectional view of the body of FIG. 14A through a clutch mechanism.
Figure 15A:
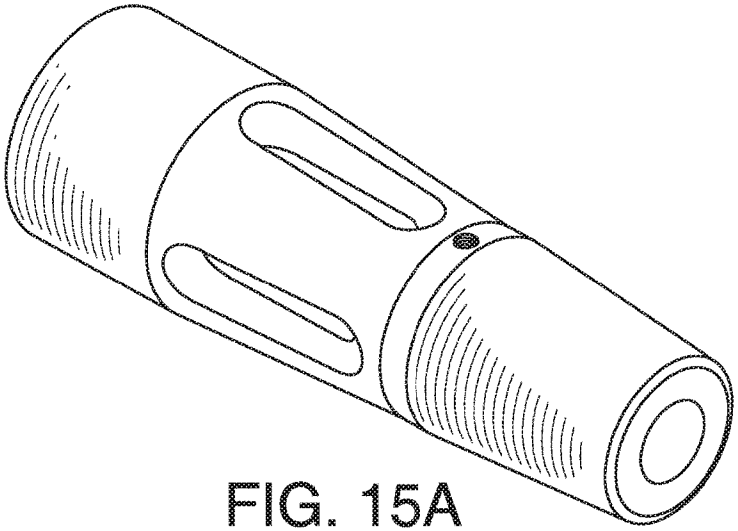
FIG. 15A depicts a perspective view of another embodiment of the nose of a dart plunger body in accordance with the current invention. The dimensions and depth of the drilled bores differ than the embodiment shown in FIG. 14A.
Figure 15B:
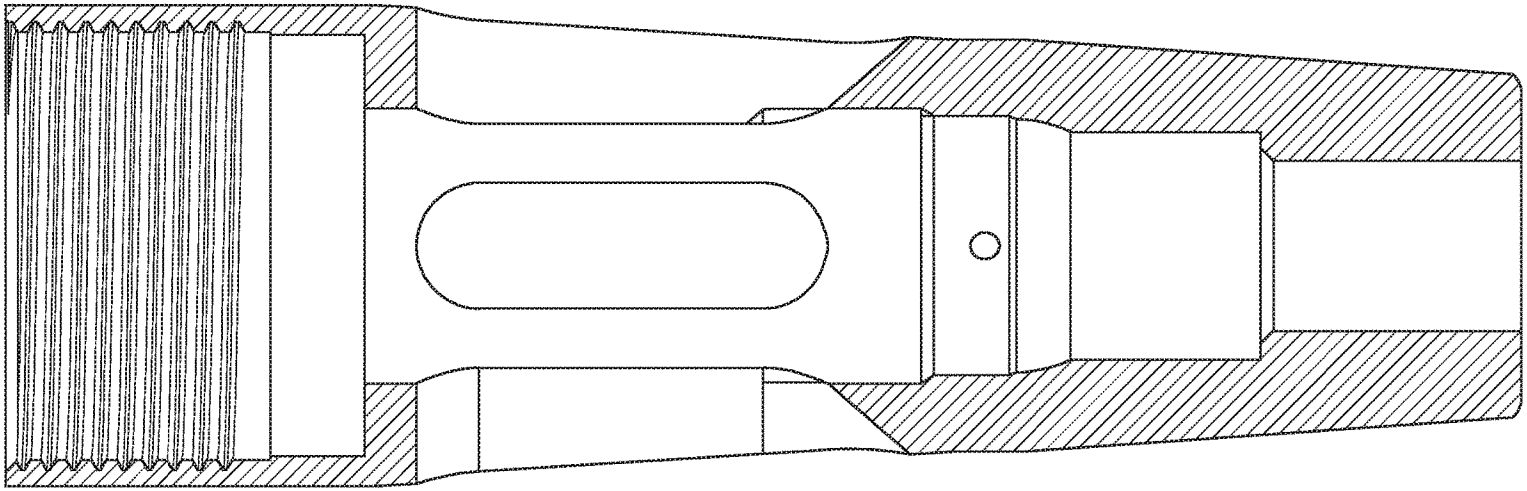
FIG. 15B is a cross sectional view of the body of FIG. 15A.
Figure 15C:
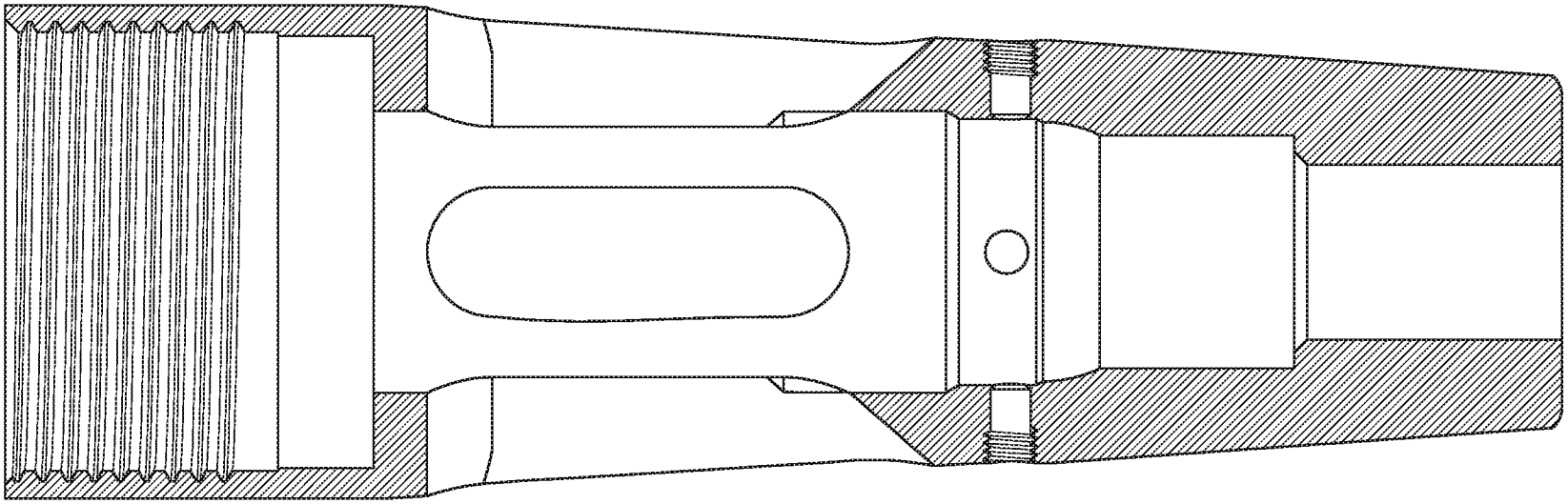
FIG. 15C is a cross sectional view of the body of FIG. 15A through a clutch mechanism.
Figure 16A:
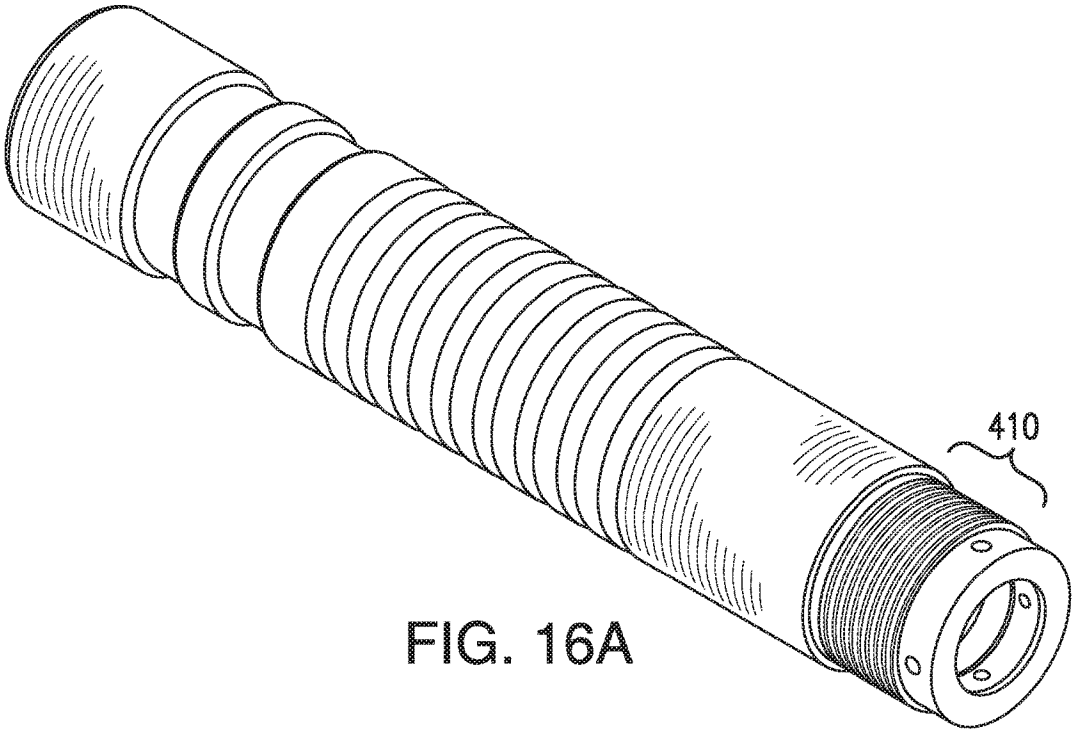
FIG. 16A is a schematic view of an alternate embodiment of a dart plunger body in accordance with the current invention in which the nose is threaded to the body of the dart plunger by acme threads
Figure 16B:
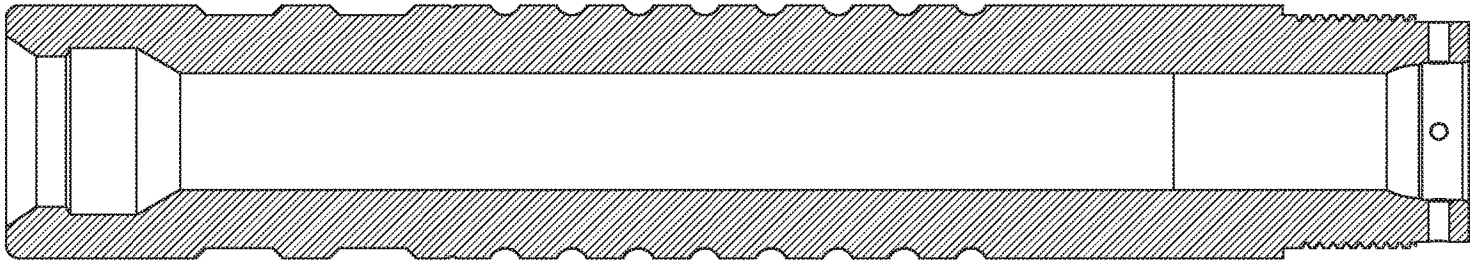
FIG. 16B is a cross sectional view of the alternate embodiment of the dart plunger body of FIG. 16A.

As shown in FIGS. 12-13B, clutch assembly 340 includes several clutch mechanisms 341. Each clutch mechanism 341 preferably comprises ball 342 (or détente or any other retention means), which is preferably made of stainless steel, spacer 344 and socket screw 346 (or any other fastener means that holds the retention means and spacer or biasing means in place). Spacer 344 may be alternatively a spring 345 as shown in FIG. 3 or any other biasing means/member that provides flexibility for ball to retract or extend (such as, for example, Buna Rubber Spacers). Spacer 344 or any other biasing mean that is being used can be made of rubber or any other flexible material as contemplated by a person of skill in the art. The number of mechanisms can vary without departing from the scope of the invention. Retractable ball 342 is biased toward the interior of the dart nose by spacer 344 or spring 345, and is movable between a fully biased position in which at least a portion of the ball 342 protrudes to internal channel 382 to a retracted position in which the exterior most surface of ball 342 is even with the interior surface of the dart body. The protrusion of the ball into the bore of the dart body allows the gripping and holding of the pin in place and can be adjusted to give the right tension on the dart pin as per operator preference. The clutch assembly of the durable dart plunger of the current invention is replaceable. The current invention also provides kits comprising replacement parts for clutch assembly 340, wherein the clutch assembly can be replaced at a well site or an offsite location such as a warehouse or service facility.

Clutch assembly 340 as shown in FIG. 12 is inserted into holes drilled through the end of nose 380. Holes drilled at the end of nose 380 extend all the way into an internal flow passage way 382 through the body itself so that a portion of the ball extends into the internal passage way of the nose. The ball is inserted followed by the biasing members and the set screws. The set screws can be later removed and the ball and/or the biasing means can be removed or replaced when the clutch assembly loses effectiveness and/or the capacity of holding the pin in the open or closed position. This allows for the easy replacement of the clutch assembly.

Body 330 includes a plurality of exterior rings 334 (also referred to as seal rings 334) and grooves 332 that provide a functional seal between the tubing and plunger and help create a sealing turbulent gas flow that prevents liquids being lifted by the plunger from falling past the plunger during the ascent phase in the well.

During operation, the plunger pin 320 is normally in one of two configurations, a fully extended open bypass configuration (when the plunger is falling down the well) as shown in FIG. 13A and in a closed configuration/mode (when the plunger is lifting liquids and travelling upwards in the well) as shown in FIG. 13B. When the plunger falls down the wellbore, pin 320 is in a fully open configuration until it hits a lower bumper assembly located near the bottom of the well. The collision with the lower bumper assembly pushes the pin up through nose 380 to the closed bypass position. At this position, ball 342 of clutch assembly 340 holds the pin in position by means of grooves on lower end of pin/dart 320 until an axial force is applied to pin/dart 320 (by a rod in the surface lubricator) and moves the pin to the open bypass position. In the closed position, the tapered part at the upper end of pin/dart 320 mates with a mating profile in the valve seat located at the bottom of sleeve 310 thereby forming a closed structure and an effective seal. Gas from the formation flows into the wellbore beneath the plunger, until enough pressure is built that lifts the plunger and any liquid above the plunger upwards in the well. Gas also flows around rings 334 of body 330 of the dart plunger creating a turbulent and sealing flow that prevents liquids above the plunger from falling between plunger body and the well tubing as the plunger ascends in the wellbore. At the end of its upward journey, the dart plunger collides with a separator rod located in catcher assembly/lubricator housing (FIG. 1). The rod will pass inside the sleeve until it hits top of pin 320 and dislodges it from the valve seat and pushes the pin down relative to body 330 into the bypass open configuration as shown in FIG. 13A. This way the plunger falls down the well without having to shut in the well. More particularly, gas flowing in the well beneath the plunger will flow through chokes 350, above the pin or dart 320, past the open valve seat and up through the longitudinally extending flow passage through sleeve 310 and onto the surface of the well as the plunger falls. Once the plunger hits the lower bumper assembly, the pin 320 will be shifted back to the closed position and the cycle will be repeated. Pin/dart 320 may include as shown in FIG. 13A-B a plurality of rings/grooves on its lower end that provides a better gripping surface for the clutch mechanism to engage. The rings, improves the gripping capability of the ball member of the clutch assembly to prevent the pin from shifting during the ascent or descent of the plunger (i.e., to maintain the pin in either the open or closed position).

To assemble the dart plunger of the current invention, pin 320 is dropped into dart body 330 until the threaded end of the pin is caught by clutch assembly 340. Dart plunger sleeve 310 is then inserted into dart body 330. Threads 311 of sleeve 310 engage receiving threads 331 that are located on upper end 381 of dart body 330, as shown in FIG. 12. Pin 320 includes a tapered seal at its upper end. The seal seals against a sealing valve seat located at the bottom of sleeve 310 when the dart plunger is in the closed position. After the pin is dropped in first and the sleeve is inserted and threaded into dart body 330, the Grappler system or clutch assembly 340 is assembled and installed into dart body 330. Inspections are made to ensure that the pin aligns straight and is not shifted, sleeve and dart body fully threaded and bottom-out completely so as not to leave a gap between the two parts. Once clutch mechanisms (grapplers) are installed, tension is tested with a 2-3 lb weight (for example) to ensure that the pin does not easily collapse or fall in. Lastly, dart body 330 and sleeve 310 are welded to ensure that the parts do not break apart or separated after normal tear is visible.

Referring to FIGS. 14-16B, presented is an alternate embodiment of the dart plunger of the current invention that is made of two pieces: body 330 and nose 380. Nose 380 is threaded to body 330 via any connection means known to a person of skill in the art, such as, for example, the acme threads 410 shown in FIG. 16A on body 330 which thread onto matching threads on the accompanying nose piece. Loctite may also be added as cementing material or the pieces may also be welded together. This embodiment provides ability to use with the same dart plunger body different noses, each nose having a different number and/or sizes of chokes depending on the application and well parameters. One of skill in the art will appreciate that field personnel can change choke sizes at the well site with this embodiment to optimize the plunger's operation based on the existing well conditions, thereby decreasing either the downtime in the well's production or the inventory of plungers field personnel need to have available to optimize performance.

The invention herein also provides a method for lifting fluids out of a hydrocarbon wellbore that includes providing a bypass dart plunger having a dart body; a pin positioned within said dart body, wherein the pin is movable between an open and a closed position; a sleeve configured to fit into the dart body such that the sleeve has a flow passage extending longitudinally therethrough and a valve seat for receiving the pin to close said flow passage when the pin is in the closed position; one or more flow parts extending through the dart body; and a clutch assembly comprising a plurality of clutch mechanisms, wherein each of the clutch mechanisms includes a retention means, a biasing means for biasing the retention means into gripping engagement with the pin, and a fastener means, holding the pin in the closed position with said clutch assembly and preventing gas from flowing through said flow passage; and lifting fluids out of the wellbore by said bypass dart plunger. In an embodiment of the current invention, the method for lifting fluids further includes replacing the clutch assembly with a new clutch assembly, and reusing the bypass dart plunger with the new clutch assembly to lift fluids out of a hydrocarbon well.

The current invention also provides a method for lifting fluids out of a hydrocarbon wellbore such that the method includes the steps of providing a bypass dart plunger having a dart body; a pin positioned within said dart body, wherein the pin is movable between an open and a closed position; a sleeve configured to fit into the dart body such that the sleeve has a flow passage extending longitudinally therethrough and a valve seat for receiving the pin to close the flow passage when the pin is in the closed position; one or more flow parts extending through the dart body; and a clutch assembly comprising a plurality of clutch mechanisms, wherein each of the clutch mechanisms includes a retention means, a biasing means for biasing the retention means into gripping engagement with the pin, and a fastener means, holding the pin in the open position within the clutch assembly; and allowing gas to flow through the flow ports, around the pin, and through the flow passageway while the plunger falls in the wellbore.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

What is claimed is:

1. A bypass dart plunger for a plunger lift assembly having a separator rod above a hydrocarbon wellbore, said bypass dart plunger comprising:

a dart body;

a pin positioned within said dart body, wherein said pin is movable between an open and a closed position;

a sleeve configured to fit into said dart body and receive said separator rod, wherein said sleeve has a longitudinal section, said longitudinal section includes a first end and a second end through said longitudinal section, said longitudinal section is configured to be affixed to said dart body at said first end and includes a valve seat on said second end for receiving said pin to close said flow passage.

2. The bypass dart plunger of claim 1, wherein the dart body includes an upper end and a lower end, said lower end comprises a nose piece having one or more flow ports that extend through said dart body.

3. The bypass dart plunger of claim 2, wherein said one or more flow ports are in communication with said flow passageway when said pin is in said open position.

4. The bypass dart plunger of claim 2, wherein said nose piece is an integral part of said dart body.

5. The bypass dart plunger of claim 2, wherein said nose piece is detachable from said dart body.

6. The bypass dart plunger of claim 2, wherein said nose piece comprises one or more helical grooves.

7. The bypass dart plunger of claim 6, wherein said one or more flow ports are located in said one or more helical grooves.

8. The bypass dart plunger of claim 1, further comprising a clutch assembly comprising a plurality of clutch mechanisms to hold the pin in the open or in the closed position, wherein each of said clutch mechanisms comprises a retention means, a biasing means and a fastener means, wherein said biasing means biases the retention means into gripping engagement with the pin.

9. The bypass dart plunger of claim 8, wherein the retention means is a ball, said biasing means is a spring and said fastener is a socket screw.

10. The bypass dart plunger of claim 1, wherein said sleeve is affixed to said dart body by threads.

11. The bypass dart plunger of claim 1, wherein the number of said one or more flow ports is between 1 and 5.

12. A bypass dart plunger for a plunger lift assembly having a separator rod above a hydrocarbon wellbore, said bypass dart plunger comprising:

a dart body having an upper end and a lower end;

wherein said lower end comprising a nose piece;

wherein said nose piece includes one or more flow ports; and a sleeve includes a longitudinal section that is configured to fit into said dart body and receive said separator rod, wherein said longitudinal section includes a first end that is in said upper end and second end that is in said lower end; and wherein said dart body and said sleeve are configured to affixed at said upper end of said dart body and said first end of said longitudinal section.

13. The bypass dart plunger of claim 12, further comprising a pin positioned within said dart body, wherein said pin in movable between an open and a closed position.

14. The bypass dart plunger of claim 13, wherein said sleeve further comprising a flow passage extending longitudinally through said longitudinal section.

15. The bypass dart plunger of claim 14, wherein said sleeve further comprising a valve seat on said second end of said longitudinal section for receiving said pin to close said flow passage.

16. The bypass dart plunger of claim 14, wherein said one or more flow ports are in communication with said flow passageway when said pin is in said open position.

17. The bypass dart plunger of claim 12, wherein said nose piece comprises one or more helical grooves.

18. The bypass dart plunger of claim 17, wherein said one or more flow ports are located in said one or more helical grooves.

19. The bypass dart plunger of claim 12, wherein said sleeve is affixed to said dart body by threads.

20. A method for lifting fluids out of a hydrocarbon wellbore, comprising:

introducing a bypass dart plunger into said hydrocarbon wellbore, said bypass dart plunger is for a plunger lift assembly having a separator rod above said hydrocarbon wellbore and comprises:

a dart body;

a pin positioned within said dart body, wherein said pin in movable between an open and a closed position;

a sleeve configured to fit into said dart body and receive said separator rod, wherein said sleeve has a longitudinal section, said longitudinal section includes a first end and a second end opposite to said first end in a longitudinal direction and a flow passage extending longitudinally through said longitudinal section, said longitudinal section is configured to be affixed to said dart body at said first end and includes a valve seat on said second end for receiving said pin to close said flow passage when said pin is in the close position.

* * * * *